US009750289B2

(12) United States Patent
Tuan

(10) Patent No.: US 9,750,289 B2
(45) Date of Patent: Sep. 5, 2017

(54) GAUZE MASK WHICH CAN BE WORN WITH ONE HAND

(71) Applicant: Ronald Tuan, Nantou County (TW)

(72) Inventor: Ronald Tuan, Nantou County (TW)

( * ) Notice: Subject to any disclaimer, the term of this patent is extended or adjusted under 35 U.S.C. 154(b) by 305 days.

(21) Appl. No.: 14/497,497

(22) Filed: Sep. 26, 2014

(65) Prior Publication Data

US 2016/0037836 A1 Feb. 11, 2016

(30) Foreign Application Priority Data

Aug. 11, 2014 (CN) ..... 2014 1 0391929

(51) Int. Cl.
*A41D 13/11* (2006.01)
*A62B 23/02* (2006.01)

(52) U.S. Cl.
CPC ..... *A41D 13/1161* (2013.01); *A41D 13/1169* (2013.01); *A62B 23/025* (2013.01); *A41D 13/1138* (2013.01)

(58) Field of Classification Search
CPC A41D 13/11; A41D 13/1192; A41D 13/1146; A41D 13/1161; A41D 13/1184
See application file for complete search history.

(56) References Cited

U.S. PATENT DOCUMENTS 3,695,265 A * 10/1972 Brevik ..... A62B 23/06 128/206.14
6,886,563 B2 * 5/2005 Bostock ..... A41D 13/11 128/206.12
2004/0055078 A1 * 3/2004 Griesbach, III ... A41D 13/1146 2/424
2009/0145444 A1 * 6/2009 Edwards ..... A41D 13/1107 128/858

* cited by examiner

*Primary Examiner* — Ophelia A Hawthorne
(74) *Attorney, Agent, or Firm* — Bruce Stone LLP; Joseph Bruce

(57) ABSTRACT

A gauze mask which can be worn with one hand includes a mask body, a nose clip member, and a chin pressing member. The mask body is formed with a covering space to cover user's mouth and nose. Around the inner periphery edge of an opening of the mask body is disposed an adhesive layer which enables the gauze mask to be adhered around the user's nose and mouth. The nose clip member and the chin pressing member allow the gauze mask to be firmly positioned on the user's face. The gauze mask is made of breathable material, or the gauze mask can also be made of non-breathable material but is equipped with a filter, so as to allow for air exchange between inside and outside of the gauze mask.

9 Claims, 10 Drawing Sheets

GAUZE MASK WHICH CAN BE WORN WITH ONE HAND

BACKGROUND OF THE INVENTION

Field of the Invention

The present invention relates to a gauze mask, and more particularly to a gauze mask which can be worn quickly and stably with one hand.

Description of the Prior Art

FIG. 1 shows a conventional earloop gauze mask 99, which comprises a mask body and an ear loop fixed to two ends of the mask body. To put on the gauze mask 99, the user has to use two hands to pull the ear loop and wrap it around the ears. In addition to the inconvenience of using two hands whining put on the mask, long time of wearing the gauze mask would cause discomfort to the skin of the ears due to the pressure applied to the ears by the ear loop.

The present invention has arisen to mitigate and/or obviate the afore-described disadvantages by providing a gauze mask which can easily be worn with only one hand. Furthermore, the gauze mask is provided with no ear loop, which makes it easy and comfortable to wear the gauze mask.

SUMMARY OF THE INVENTION

The primary objective of the present invention is to provide a gauze mask, which can be worn with one hand, and the gauze mask of the present invention is free of the problem that the conventional gauze mask has to be worn by two hands, and would cause discomfort to the skin of the user's ears after long time of wearing.

To achieve the objective, a gauze mask, which can be worn with one hand, in accordance with the present invention comprises: a mask body, a nose clip member, and a chin pressing member. The mask body is an arc-shaped structure including an outward expanding opening, and a covering space which is formed in the opening to cover user's mouth and nose. The covering space allows for air exchange between inside and outside of the mask body. At a top portion and a bottom portion of the opening of the mask body are formed a support portion to support the user's nose and a hooking portion to be hooked to the user's nose, respectively, which enables the mask body to be positioned quickly to the mouth and nose of the user. Around the inner periphery edge of the opening of the mask body is disposed an adhesive layer which creates an adhesive force at an upper inner edge and a lower inner edge of the opening.

Preferably, the two clipping portions are connected by an elastic connecting portion which provides a prestress to push the two clipping portions toward each other and are clamped against two lateral sides of the user's nose to produce two lateral clamping forces, and a periphery edge of the opening of the mask body can be closely abutted against the user's mouth and nose in an airtight manner.

Preferably, the mask body is a breathable structure which is made of non-woven material, or high-density fabric layer or paper, so that the covering space allows for air exchange between the inside and outside of the mask body.

Preferably, a structure allowing for air exchange between the inside and outside of the mask body is a ventilation hole which is formed at the center of the elastic connecting portion, the ventilation hole is covered with a filter which includes a hollow frame and a filter layer disposed in the hollow frame, and the filter layer is a fabric layer or a composite layer or a paper layer which contain catalyst or activated carbons.

Preferably, the structure allowing for air exchange between the inside and outside of the mask body is a ventilation hole which is formed at an extension portion extending from the center of the elastic connecting portion toward the user's nose and mouth, the ventilation hole is covered with a filter which includes a hollow frame and a filter layer is disposed in the hollow frame, and the filter layer is a fabric layer or a composite layer or a paper layer which contain catalyst or activated carbons.

Preferably, the chin pressing member is elastic to elastically clamp against the user's chin.

Preferably, the adhesive layer is made of adhesive gelatinous or non-gelatinous material, and covered with a release film.

Preferably, a nose clip member disposed at a center of the top portion of the opening, and being provided at two ends thereof with two clipping portions to be abutted against two lateral sides of the user's nose, which provides an upper pressing force with respect to the user's nose.

Preferably, a chin pressing member disposed at a bottom portion of the mask body and to be abutted against the user's chin, so as to produce a lower pressing force with respect to the user's chin.

Preferably, the mask body is capable of being folded into a flat configuration and includes at least one foldable portion, and the at least one foldable portion includes a first folding line and a second folding line, at least two overlapping areas between the first and second folding lines, and a middle folding line between the two overlapping areas.

The advantage of the present invention is that the gauze mask can be worn quickly and stably with one hand, and is provided with no ear loops, so that it won't cause discomfort to the skin of the user's ears.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
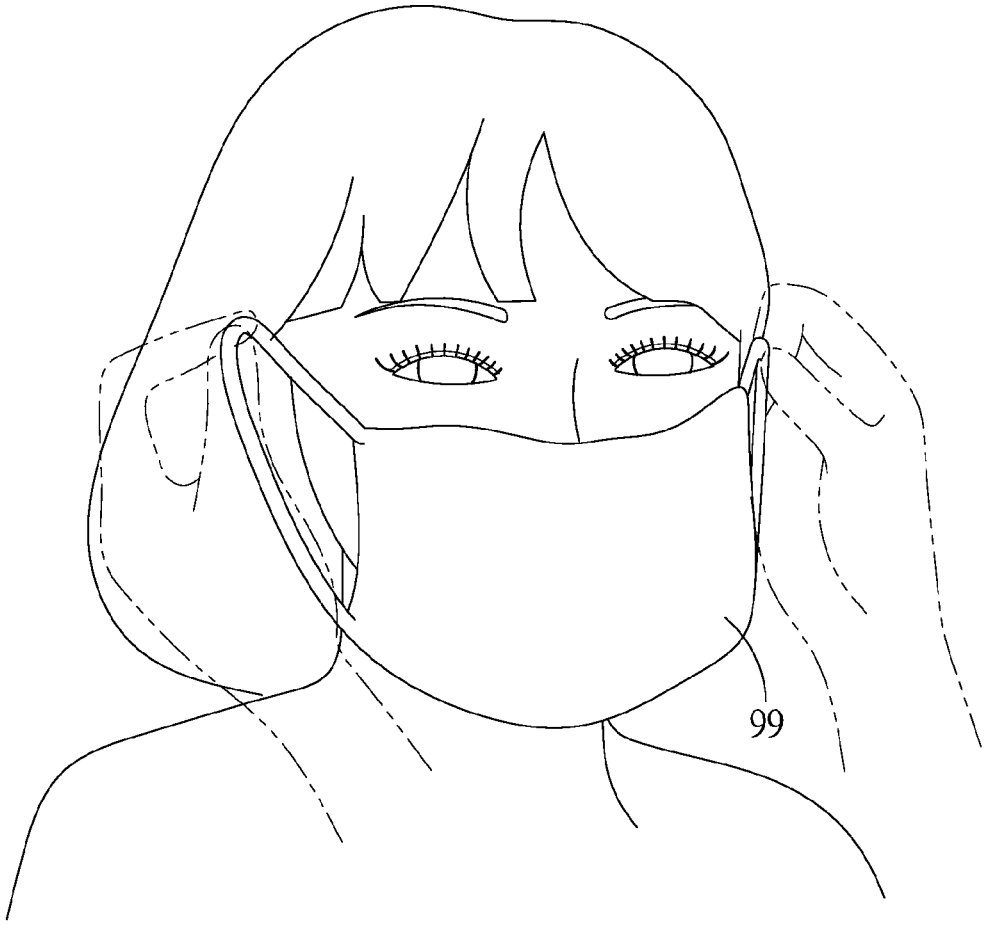
FIG.1 PRIOR ART
FIG. 1 shows a conventional earloop gauze mask.
Figure 2:
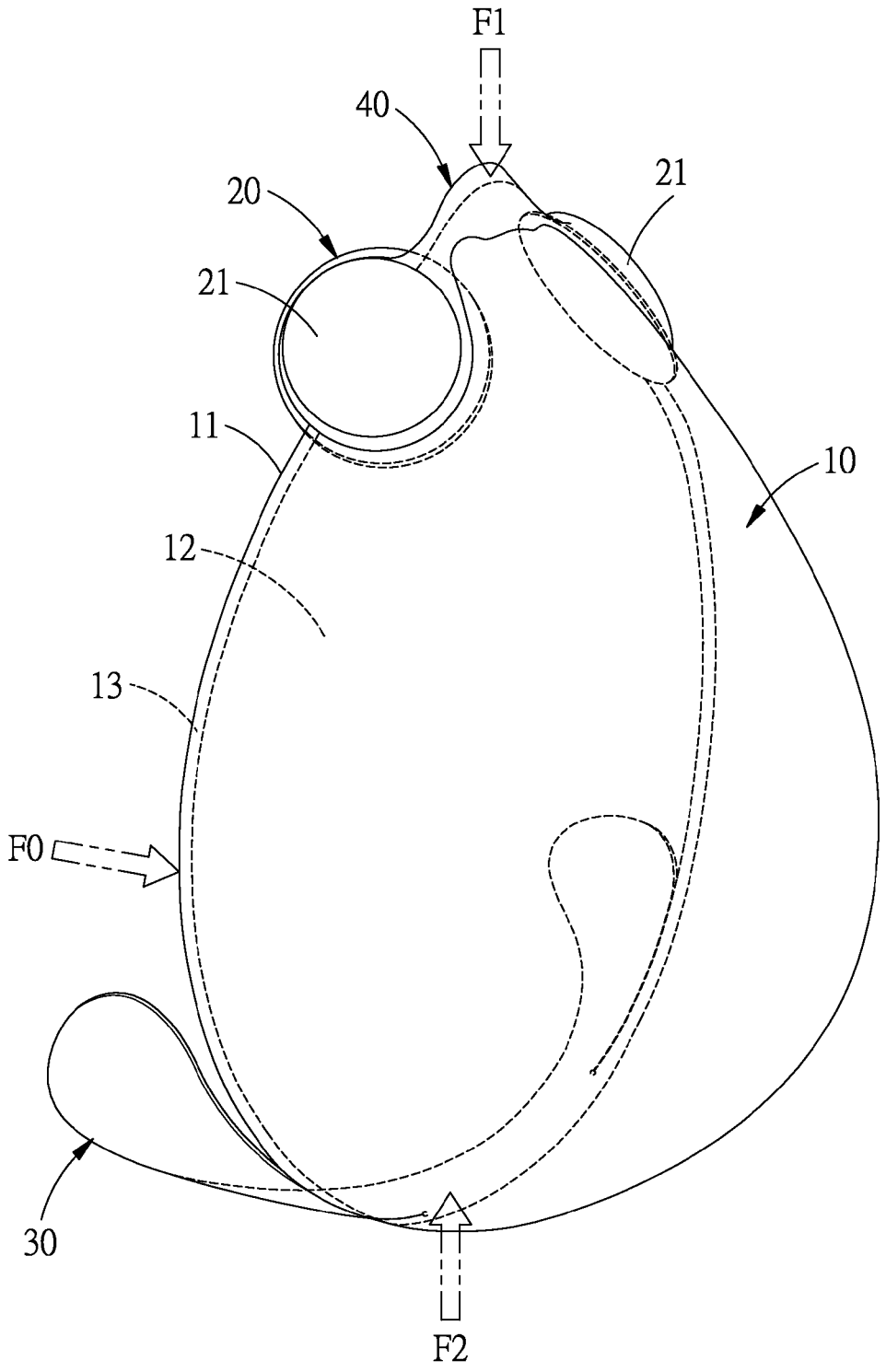
FIG. 2 is a perspective view of a gauze mask which can be worn with one hand in accordance with a first embodiment of the present invention.

Referring to FIG. 2, a gauze mask, which can be worn with one hand in accordance with a first embodiment of the present invention, comprises: a mask body 10, a nose clip member 20, and a chin pressing member 30. The mask body 10 is an arc-shaped structure with an outward expanding opening 11, and a covering space 12 which is formed in the opening 11 to cover wearer's mouth and nose. The covering space 12 allows for air exchange between the inside and outside of the mask body 10. At the top portion and bottom portion of the opening 11 of the mask body 10 are formed a support portion to support the user's nose and a hooking portion to be hooked to the user's nose, respectively, which enables the mask body 10 to be positioned quickly to the mouth and nose of the user. Around the inner periphery edge of the opening 11 of the mask body 10 is disposed an adhesive layer 13 which creates an adhesive force at the upper inner edge and lower inner edge of the opening 11 and provides an adhesive force F0 toward the user's face. The nose clip member 20 is disposed at the center of the top portion of the opening 11, and provided at two ends thereof with two clipping portions 21 to be abutted against two lateral sides of the user's nose, which provides an upper pressing force F1. The chin pressing member 30 is disposed at the bottom portion of the mask body 10 to be abutted against the user's chin, so as to produce a lower pressing force F2 with respect to the user's chin.

The two clipping portions 21 are connected by an elastic connecting portion 40 which provides a prestress to push the two clipping portions 21 toward each other, so that the two clipping portions 21 can be clamped against two lateral sides of the user's nose to produce two lateral clamping forces. With the upper and lower pressing forces F1, F2, which are produced by the nose clip member 20 and the chin pressing member 30, respectively, and applied in opposite directions to the user's nose and chin, plus the two lateral clamping forces, the gauze mask of the present invention can be quickly and easily worn with one hand, and the periphery edge of the opening 11 of the mask body 10 can be closely abutted against the user's mouth and nose in an airtight manner.

The reason why the covering space 12 allows for air exchange between the inside and outside of the mask body 10 is because the mask body 10 is a breathable structure which is made of non-woven material, or high-density fabric layer or paper.

Figure 3:
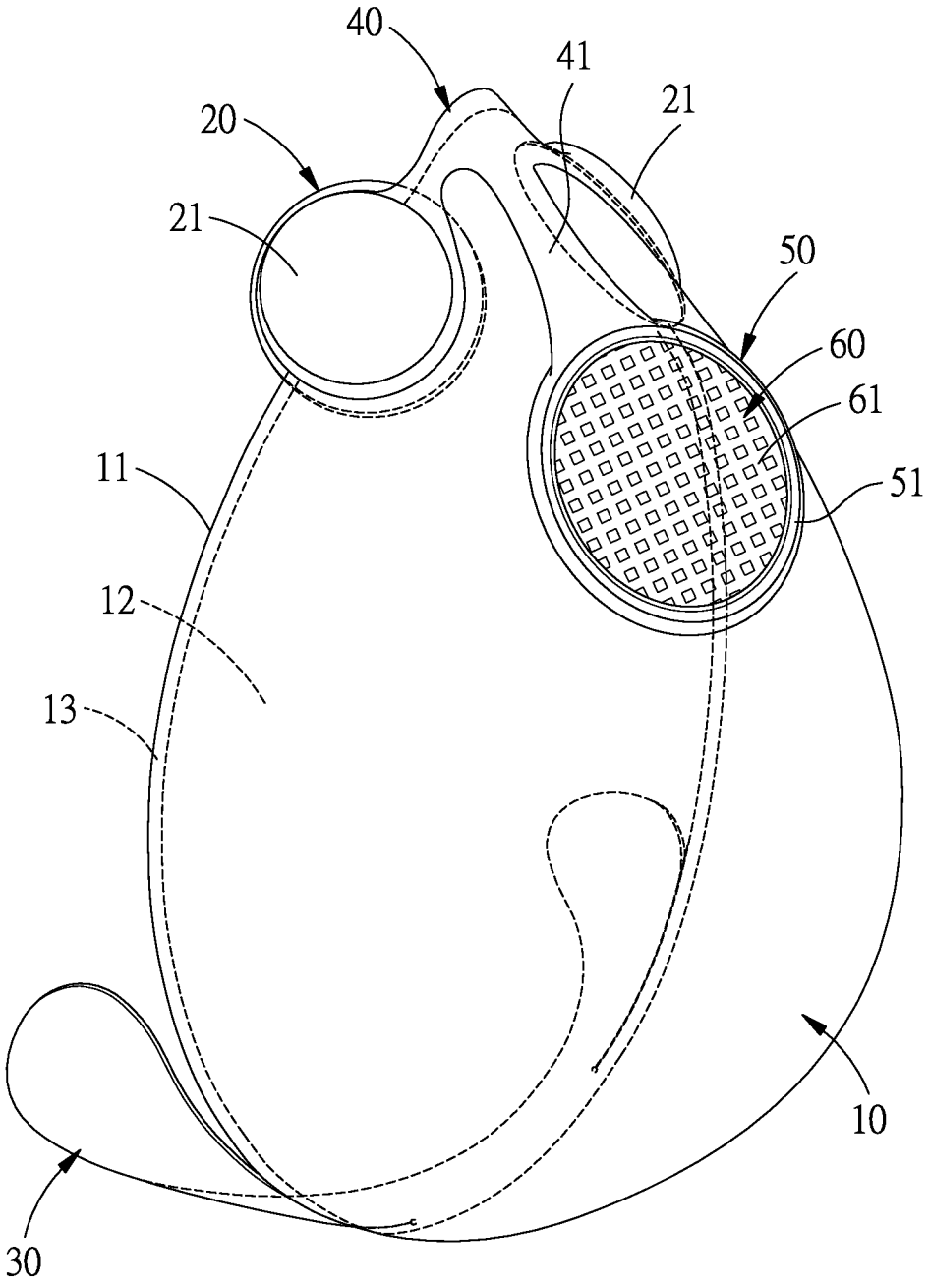
FIG. 3 is a perspective view of a gauze mask which can be worn with one hand in accordance with a second embodiment of the present invention.
Figure 4:
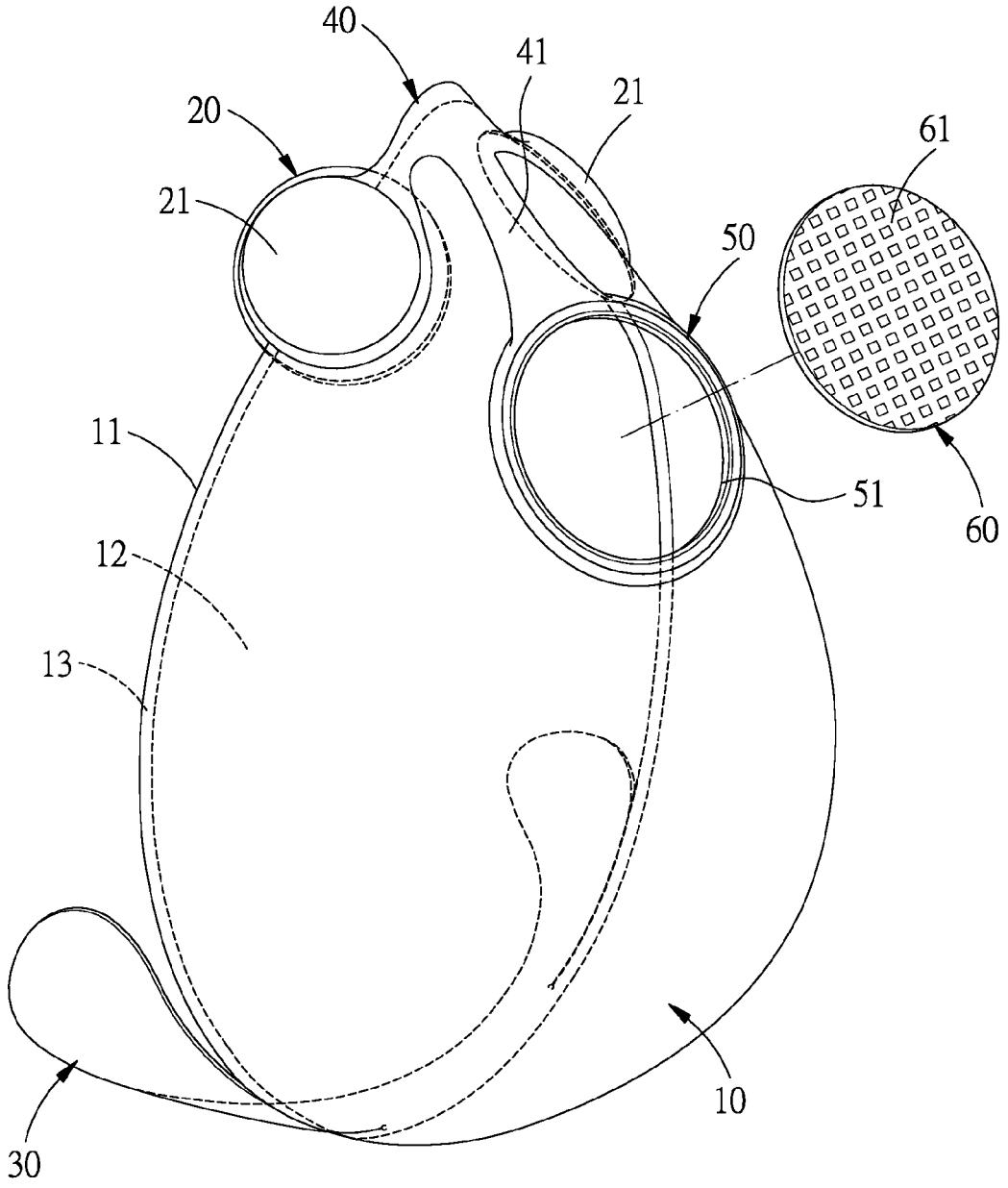
FIG. 4 is an exploded view of the gauze mask which can be worn with one hand in accordance with the second embodiment of the present invention.

Referring to FIGS. 3 and 4, a gauze mask which can be worn with one hand in accordance with a second embodiment of the present invention is similar to the first embodiment, except that: the structure allowing for air exchange between the inside and outside of the mask body 10 is a ventilation hole 50 which is formed at the center of the elastic connecting portion 40, and more specifically, the ventilation hole 50 is formed at an extension portion 41 extending from the center of the elastic connecting portion 40 toward the user's nose and mouth. The ventilation hole 50 is covered with a filter 60 which includes a hollow frame 51 and a filter layer 61 disposed in the hollow frame 51, and the filter layer 61 is fabric layer or a composite layer or a paper layer which contain catalyst or activated carbons.

Figure 5:
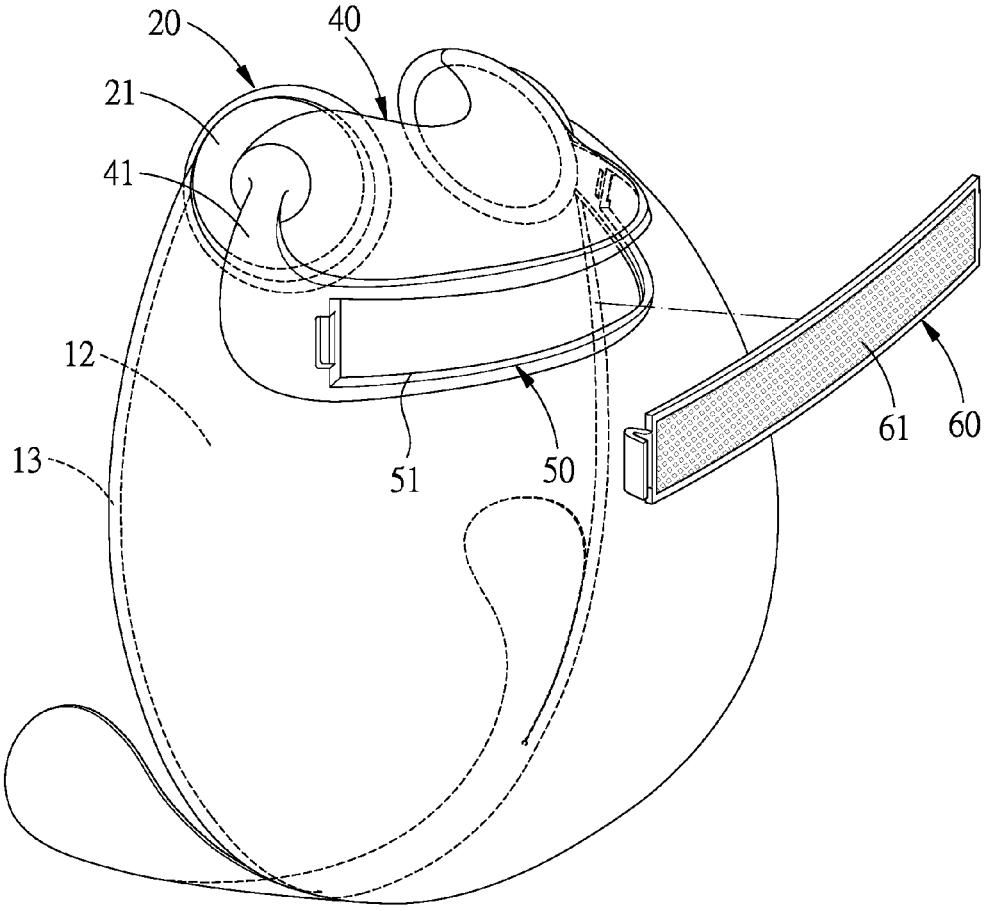
FIG. 5 is an exploded view of the gauze mask which can be worn with one hand in accordance with a third embodiment of the present invention.

Referring to FIG. 5, a gauze mask which can be worn with one hand in accordance with a third embodiment of the present invention is similar to the first embodiment, except that: the structure allowing for air exchange between the inside and outside of the mask body 10 is a ventilation hole 50 which is formed at the center of the elastic connecting portion 40. The ventilation hole 50 is covered with a filter 60 which includes a hollow frame 51 and a filter layer 61 disposed in the hollow frame 51, and the filter layer 61 is fabric layer or a composite layer or a paper layer which contain catalyst or activated carbons.

Figure 6:
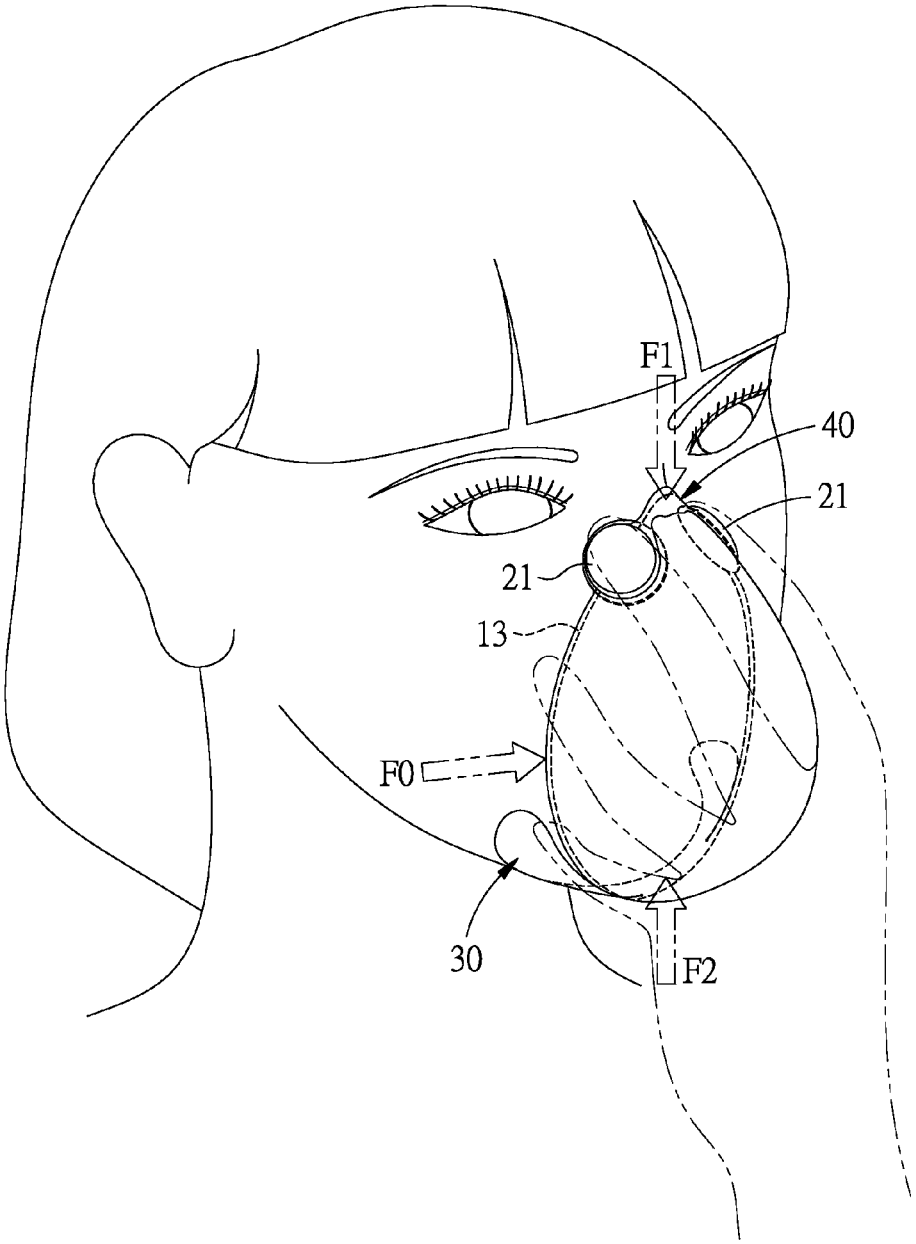
FIG. 6 is a perspective view showing that the gauze mask in accordance with the first embodiment of the present invention is put on the face.

FIG. 6 is a perspective view showing that the gauze mask in accordance with the first embodiment of the present invention is put on the face. The chin pressing member 30 is a little elastic to elastically clamp against the user's chin. The two clipping portions 21 are connected by the elastic connecting portion 40, so that the two clipping portions 21 can be clamped against two lateral sides of the user's nose to produce two lateral clamping forces. The adhesive layer 13 provides an adhesive force F0 toward the user's face.

Figure 7:
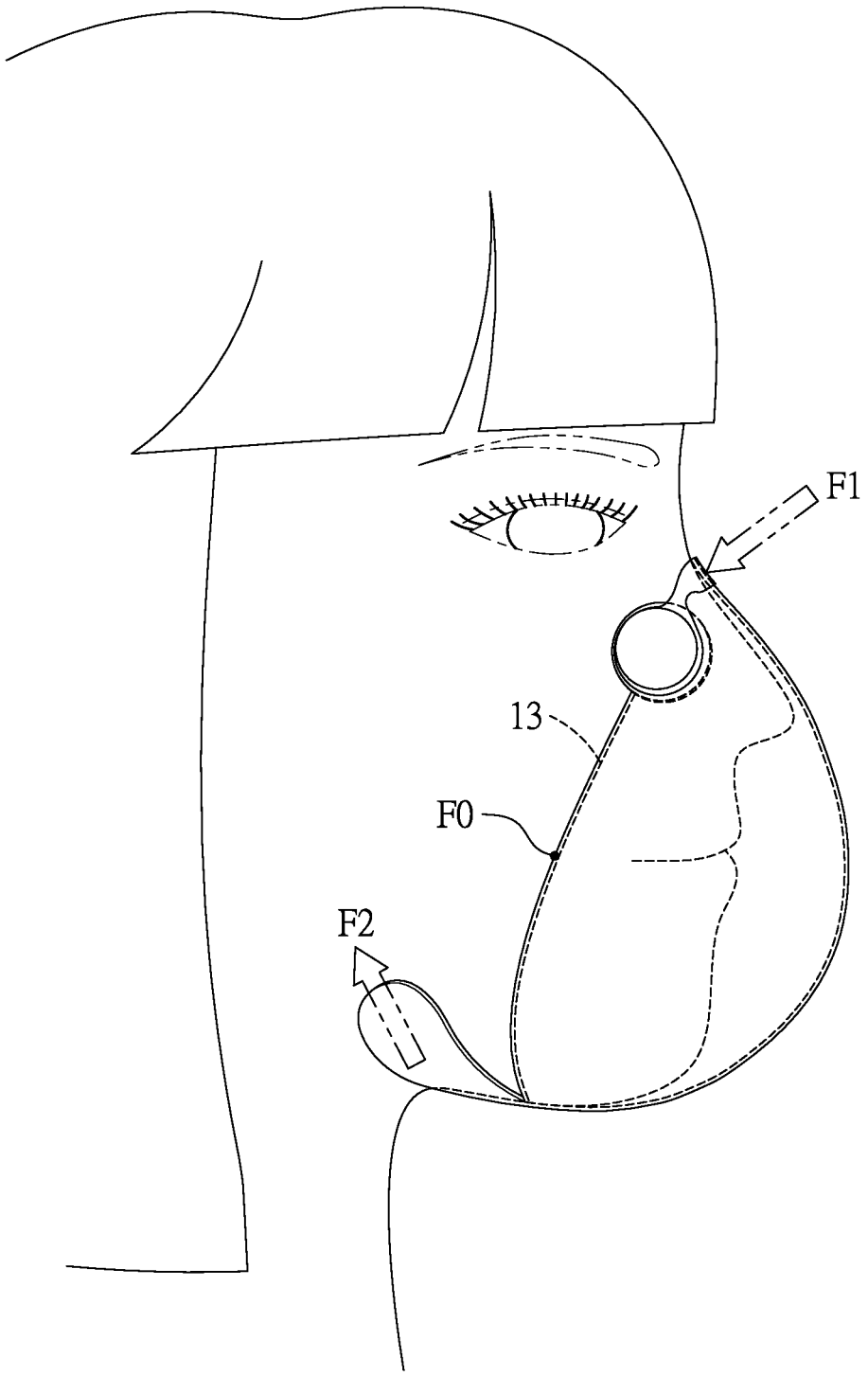
FIG. 7 is a side view showing that the gauze mask in accordance with the first embodiment of the present invention is put on the face.

FIG. 7 is a side view showing that the gauze mask in accordance with the first embodiment of the present invention is put on the face. The upper pressing force F1 produces a downward pressing force on the user's nose, and the lower pressing force F2 is an upward pressing force applied to the user's chin, and the upper and lower pressing forces F1, F2 are combined into a clamping force. The adhesive layer 13 provides an adhesive force F0 around the user's mouth and nose. Hence, the gauze mask of the present invention can be quickly and easily put on the user's face with only one hand.

Figure 8:
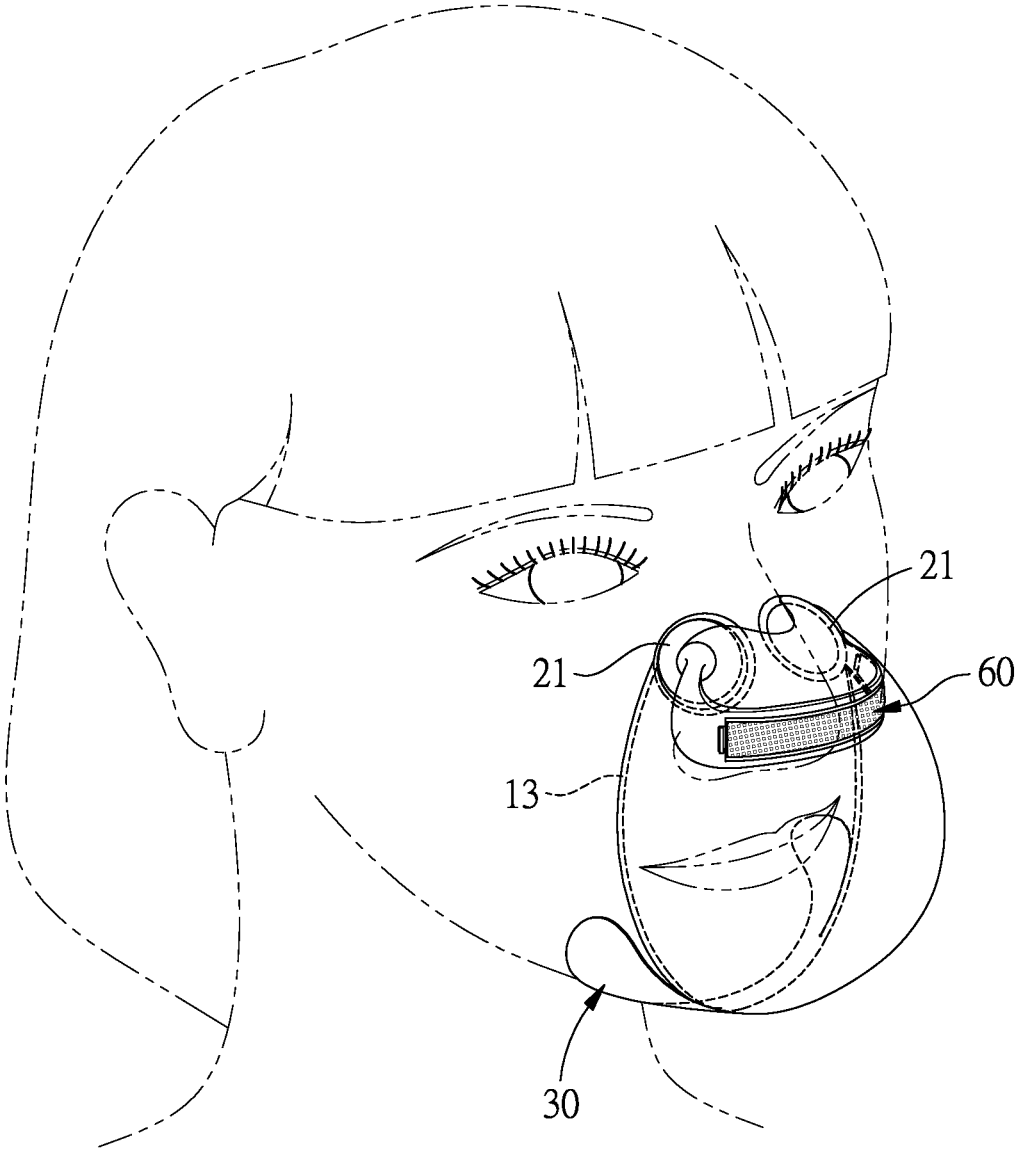
FIG. 8 is a perspective view showing that the gauze mask in accordance with the third embodiment of the present invention is put on the face.

FIG. 8 is a perspective view showing that the gauze mask in accordance with the third embodiment of the present invention is put on the face. The gauze mask covers the user's nose and mouth in such a manner that the two clipping portions 21 are clamped closely against two lateral sides of the user's nose, and the chin pressing member 30 is pressed tightly against the user's chin. The adhesive layer 13 is made of adhesive gelatinous or non-gelatinous material, and covered with a release film. The adhesive layer 13 is located around the opening and adhered to the user's nose and mouth, and the filter 60 acts as an air exchanger.

Figure 9:
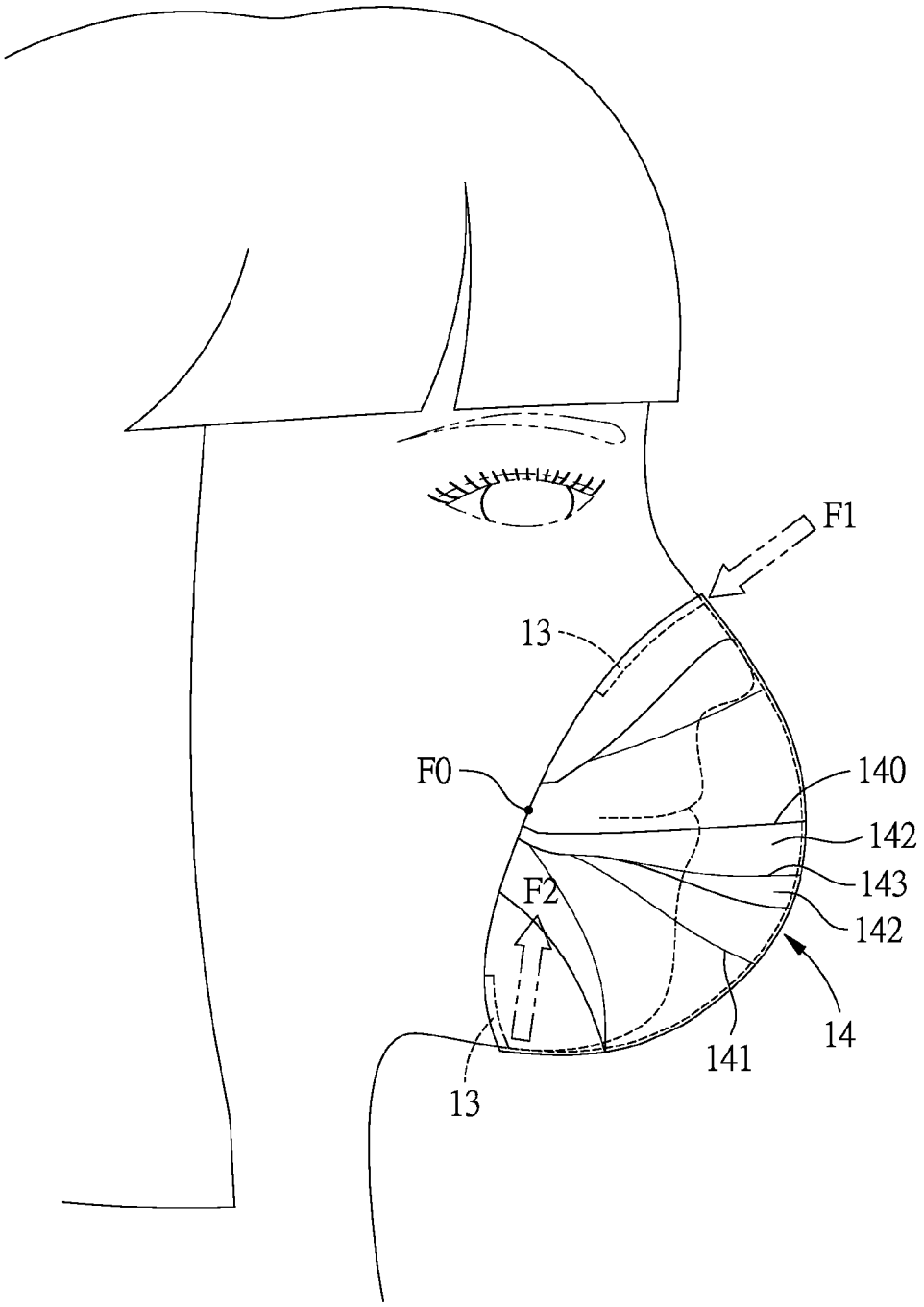
FIG. 9 is a perspective view showing that the gauze mask in accordance with a fourth embodiment of the present invention is put on the face.

Referring to FIG. 9, a gauze mask, which can be worn with one hand in accordance with a fourth embodiment of the present invention, comprises: a mask body 10, a nose clip member 20, and a chin pressing member 30. The mask body 10 is an arc-shaped structure with an outward expanding opening 11, and a covering space 12 which is formed in the opening 11 to cover wearer's mouth and nose. The covering space 12 allows for air exchange between the inside and outside of the mask body 10. At the top portion and bottom portion of the opening 11 of the mask body 10 are formed a support portion to support the user's nose and a hooking portion to be hooked to the user's nose, respectively, which enables the mask body 10 to be positioned quickly to the mouth and nose of the user. Around the inner periphery edge of the opening 11 of the mask body 10 is disposed an adhesive layer 13 which creates an adhesive force at the upper inner edge and lower inner edge of the opening 11, and also provides an upper pressing force F1 and a lower pressing force F2 to press against the user's chin.

Figure 10:
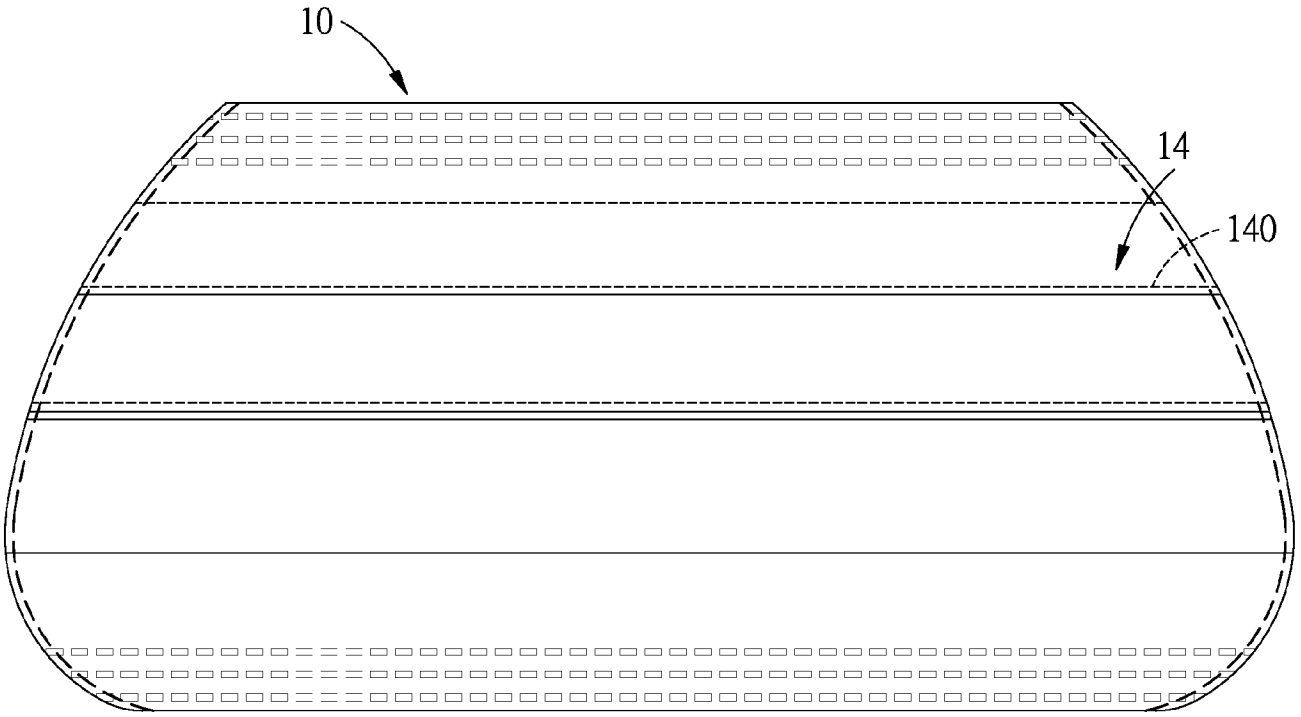
FIG. 10 is a plan view showing that the gauze mask in accordance with the fourth embodiment of the present invention is folded into a flat configuration.
Figure 11:
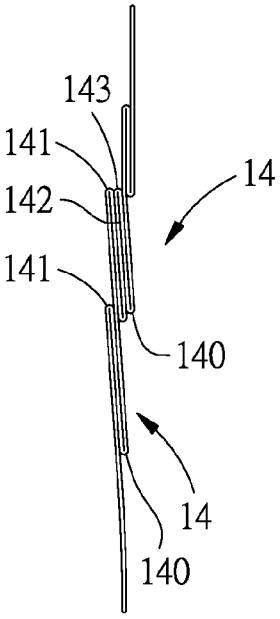
FIG. 11 is a cross sectional view of FIG. 10.

Referring then to FIGS. 10 and 11, which are a side view and a lateral cross sectional view of FIG. 9, the mask body 10 can be folded into a flat configuration and includes at least two foldable portion 14. There are three foldable portions 14 in this embodiment, each of the foldable portions 14 includes a first folding line 140 and a second folding line 141, and at least one of the foldable portion 14 further includes at least two overlapping areas 142, which is located between the first and second folding lines 140, 141, and a middle folding line 143 between the two overlapping areas 142. When the overlapping areas 142 are flatly overlapped with each other, as shown in FIGS. 10 and 11, the mask body 10 is folded into a flat configuration for easy storage. When the overlapping areas 142 are pulled out from each other, as shown in FIG. 9, the mask body 10 will be unfolded into a three dimensional configuration which is provided with the outward expanding opening 11, and the covering space 12 which is formed in the opening 11 to cover wearer's mouth and nose. The covering space 12 allows for air exchange between the inside and outside of the mask body 10. At the top portion and bottom portion of the opening 11 of the mask body 10 are formed a support portion to support the user's nose and a hooking portion to be hooked to the user's nose, respectively, which enables the mask body 10 to be positioned quickly to the mouth and nose of the user. Around the inner periphery edge of the opening 11 of the mask body 10 is disposed an adhesive layer 13 which creates an adhesive force at the upper inner edge and lower inner edge of the opening 11, and also provides an upper pressing force F1 and a lower pressing force F2 to press against the user's chin.

While we have shown and described various embodiments in accordance with the present invention, it is clear to those skilled in the art that further embodiments may be made without departing from the scope of the present invention.

What is claimed is:

1. A gauze mask which can be worn with one hand, comprising:

a mask body being an arc-shaped structure including an outward expanding opening, and a covering space which is formed in the opening and configured to cover user's mouth and nose, the covering space allowing for air exchange between inside and outside of the mask body, at a top portion and a bottom portion of the opening of the mask body being formed a support portion adapted to support the user's nose and a hooking portion adapted to be hooked to the user's nose, respectively, around an inner periphery edge of the opening of the mask body being disposed an adhesive layer which creates an adhesive force at an upper inner edge and a lower inner edge of the opening;

wherein a nose clip member is disposed at a center of the top portion of the opening, and is provided with two clipping portions and an elastic connecting portion connected between the two clipping portions, the two clipping portions are configured to be abutted against two lateral sides of the user's nose to provide an upper pressing force with respect to the user's nose, the elastic connecting portion provides a prestress to push the two clipping portions toward each other, so that the two clipping portions are capable of clamping against two lateral sides of the user's nose to produce two lateral clamping forces, and a periphery edge of the opening of the mask body is capable of pressing against the user's mouth and nose in an airtight manner.

2. The gauze mask which can be worn with one hand as claimed in claim 1, wherein the mask body is a breathable structure which is made of non-woven material, or high-density fabric layer or paper, so that the covering space allows for air exchange between the inside and outside of the mask body.

3. The gauze mask which can be worn with one hand as claimed in claim 2 further comprises a chin pressing member disposed at a bottom portion of the mask body and adapted to be abutted against the user's chin, so as to produce a lower pressing force with respect to the user's chin.

4. The gauze mask which can be worn with one hand as claimed in claim 1, wherein a structure allowing for air exchange between the inside and outside of the mask body is a ventilation hole which is formed at a center of the elastic connecting portion, the ventilation hole is covered with a filter which includes a hollow frame and a filter layer disposed in the hollow frame, and the filter layer is a fabric layer or a composite layer or a paper layer which contain catalyst or activated carbons.

5. The gauze mask which can be worn with one hand as claimed in claim 1, wherein a structure allowing for air exchange between the inside and outside of the mask body is a ventilation hole which is formed at an extension portion extending from a center of the elastic connecting portion toward the user's nose and mouth, the ventilation hole is covered with a filter which includes a hollow frame and a filter layer disposed in the hollow frame, and the filter layer is a fabric layer or a composite layer or a paper layer which contain catalyst or activated carbons.

6. The gauze mask which can be worn with one hand as claimed in claim 1, wherein the chin pressing member is elastic and adapted to elastically clamp against the user's chin.

7. The gauze mask which can be worn with one hand as claimed in claim 1, wherein the adhesive layer is made of adhesive gelatinous or non-gelatinous material, and covered with a release film.

8. The gauze mask which can be worn with one hand as claimed in claim 1, wherein the adhesive layer provides an adhesive force to adhere the gauze mask to the user's face in an aright manner.

9. The gauze mask which can be worn with one hand as claimed in claim 1, wherein the mask body is capable of being folded into a flat configuration and includes at least one foldable portion, and the at least one foldable portion includes a first folding line and a second folding line, at least two overlapping areas between the first and second folding lines, and a middle folding line between the two overlapping areas.

* * * * *